US011891825B2

(12) United States Patent
Gantt

(10) Patent No.: US 11,891,825 B2
(45) Date of Patent: Feb. 6, 2024

(54) APPARATUS FOR SUPPORTING OVERHEAD STRUCTURE

(71) Applicant: Independence Materials Group, LLC, Virginia Beach, VA (US)

(72) Inventor: William A. Gantt, Blair, SC (US)

(73) Assignee: Independence Materials Group, LLC, Virginia Beach, VA (US)

( * ) Notice: Subject to any disclaimer, the term of this patent is extended or adjusted under 35 U.S.C. 154(b) by 172 days.

(21) Appl. No.: 16/591,313

(22) Filed: Oct. 2, 2019

(65) Prior Publication Data

US 2020/0102749 A1 Apr. 2, 2020

Related U.S. Application Data

(60) Provisional application No. 62/740,350, filed on Oct. 2, 2018.

(51) Int. Cl.
*E04H 12/22* (2006.01)
*E02D 27/42* (2006.01)
(Continued)

(52) U.S. Cl.
CPC ..... *E04H 12/2261* (2013.01); *E02D 27/42* (2013.01); *E04G 25/065* (2013.01); *E04C 3/32* (2013.01); *E04G 2025/003* (2013.01)

(58) Field of Classification Search
CPC . E04G 25/065; E04G 2025/003; E04G 25/00; E04G 5/025; E02D 29/14;
(Continued)

(56) References Cited

U.S. PATENT DOCUMENTS 1,333,523 A * 3/1920 Williams, Jr. ..... F16B 9/052 52/295
1,859,739 A * 5/1932 Keating ..... E02D 29/14 404/25
(Continued)

FOREIGN PATENT DOCUMENTS

AU 2005228921 B2 * 5/2010 ..... E04F 11/1812
DE 4400360 A1 * 7/1995 ..... E04G 5/025
(Continued)

OTHER PUBLICATIONS

Derwent Abstract of KR 2000066927 A by Lee (Year: 2000).*
(Continued)

*Primary Examiner* — Brian D Mattei
*Assistant Examiner* — Charissa Ahmad
(74) *Attorney, Agent, or Firm* — Moore & Van Allen PLLC; Jeffrey R. Gray

(57) ABSTRACT

A support apparatus having a base to support a support member which, in turn, supports a structure (e.g., a building joist, overhead structure, combinations thereof). The support apparatus may be used to provide reinforcement between a floor (e.g., ground, substrate, or the like) and the structure. The base of the support apparatus is in the form of a generally planar circular base, but may have any shape. The base may include one or more platforms, recesses, or ribs in order to provide structural support to the base and/or locations for one or more fastener apertures. The one or more fastener apertures are configured to receive one or more fasteners for operatively coupling the base to the floor in order to resist movement of the base during installation and/or use of the support apparatus.

10 Claims, 11 Drawing Sheets

(51) Int. Cl.
*E04G 25/06* (2006.01)
*E04C 3/32* (2006.01)
*E04G 25/00* (2006.01)

(58) Field of Classification Search
CPC ..... E02D 27/42; E04H 12/22; E04H 12/2261; E04C 3/32
See application file for complete search history.

(56) References Cited

U.S. PATENT DOCUMENTS 3,027,140 A * 3/1962 Holzbach ..... E04G 25/065 254/98
3,222,030 A * 12/1965 Thorpe ..... E04F 15/02452 254/100
3,398,933 A * 8/1968 Haroldson ..... E04F 15/0247 248/354.3
3,425,179 A * 2/1969 Haroldson ..... E04F 15/02452 52/301
3,655,161 A 4/1972 Schueler
4,048,776 A * 9/1977 Sato ..... E04H 12/2261 52/297
4,070,837 A * 1/1978 Sato ..... E04C 3/30 248/169
4,079,559 A * 3/1978 Tenbrummeler ..... E02D 27/42 248/519
4,266,809 A * 5/1981 Wuerflein ..... B66C 23/78 403/336
D273,712 S * 5/1984 Ahlqvist ..... E04B 1/38 D25/133
4,558,544 A * 12/1985 Albrecht ..... E04F 15/02452 52/126.6
4,574,551 A * 3/1986 Giannuzzi ..... E04D 3/3603 411/154
4,685,258 A * 8/1987 Av-Zuk ..... E04F 15/02452 52/126.6
4,763,456 A * 8/1988 Giannuzzi ..... E04D 3/3603 411/133
4,780,571 A * 10/1988 Huang ..... E04F 15/02476 52/220.1
4,894,970 A * 1/1990 Lebraut ..... E04D 3/3608 52/410
5,232,204 A 8/1993 Nunez
5,297,779 A * 3/1994 Collins, Jr. ..... B66F 3/08 254/98
D348,738 S * 7/1994 Jasinsky ..... E01F 9/677 D25/133
5,505,033 A * 4/1996 Matsuo ..... E02D 27/42 52/169.9
5,666,774 A * 9/1997 Commins ..... E04H 12/2253 248/188.4
5,740,645 A * 4/1998 Raby ..... E02D 27/42 248/346.5
5,743,505 A * 4/1998 Sofy ..... A47G 33/12 248/346.03
5,758,854 A * 6/1998 Shih ..... E04G 25/061 248/354.3
5,791,096 A * 8/1998 Chen ..... E04F 15/02458 52/126.6
5,816,554 A * 10/1998 McCracken ..... H01Q 1/12 248/346.01
6,141,928 A * 11/2000 Platt ..... E04F 11/1814 52/832
6,324,800 B1 * 12/2001 Valentz ..... E04G 5/00 52/298
6,336,620 B1 * 1/2002 Belli ..... E04F 11/1814 248/519
6,345,474 B1 * 2/2002 Triplett ..... E02D 27/01 52/126.6
6,712,330 B1 * 3/2004 Damiano ..... E04H 12/2269 248/519
6,988,700 B2 * 1/2006 Cote ..... E04H 12/2269 248/519
7,188,821 B2 * 3/2007 Curtis ..... E01F 9/677 248/529
7,533,506 B2 * 5/2009 Platt ..... E04H 12/2261 52/296
D599,915 S * 9/2009 Godwin ..... E04H 12/2261 D25/133
8,365,475 B2 * 2/2013 Zlatar ..... E04F 15/02452 52/126.6
8,757,598 B1 * 6/2014 Jones ..... E04H 12/2261 256/65.14
9,004,439 B2 * 4/2015 Gross ..... E04H 12/2269 248/507
9,410,296 B2 * 8/2016 Tabibnia ..... E04F 15/0247
D767,167 S * 9/2016 Masuda ..... E04H 12/2269 D25/133
9,476,218 B2 * 10/2016 Takahashi ..... E04B 1/2403
9,554,649 B2 * 1/2017 Saich ..... H01Q 1/12
9,587,401 B1 3/2017 Benton
D824,543 S * 7/2018 Crawley ..... E04B 1/38 D25/133
10,190,616 B2 * 1/2019 MacDonald ..... E04D 5/145
D844,424 S * 4/2019 MacDonald ..... B66F 3/08 D8/399
10,896,774 B2 * 1/2021 Stilwell ..... H01B 17/14
11,002,018 B2 * 5/2021 Pilja ..... E04H 12/2261
11,248,390 B1 * 2/2022 Queen ..... B28B 1/14
2002/0040956 A1 * 4/2002 Carnahan ..... F16M 11/22 248/188.8
2007/0158526 A1 * 7/2007 Platt ..... E04H 12/2261 248/188.4
2007/0186498 A1 * 8/2007 Buzon ..... E04F 15/02161 52/489.1
2007/0187564 A1 * 8/2007 McGuire ..... E04H 12/2261 248/346.5
2008/0016795 A1 * 1/2008 George ..... E02D 27/16 52/169.9
2010/0243849 A1 * 9/2010 Wang ..... E04G 25/08 248/354.4
2015/0189988 A1 * 7/2015 Saich ..... F24F 13/32 211/183
2016/0356521 A1 * 12/2016 Bertini ..... F24F 13/029
2018/0283011 A1 * 10/2018 Pilja ..... E04H 12/2261

FOREIGN PATENT DOCUMENTS

DE 19611435 A1 * 3/1997 ..... E04G 25/063
DE 102010044193 A1 * 5/2012
GB 2515250 A * 12/2014
JP 58011228 A * 1/1983 ..... E02D 29/14
JP 59233029 A * 12/1984 ..... E02D 29/14
JP 08042164 A * 2/1996 ..... E04G 5/025
JP 09053331 A * 2/1997 ..... E04G 25/061
JP 11061868 A * 3/1999 ..... E02D 29/14
JP 11101004 A * 4/1999 ..... E04G 25/063

OTHER PUBLICATIONS

Derwent Abstract of KR 2005086080 A by Jung et al. (Year: 2005).*
Derwent Abstract of CN 203188247 U by Feng et al. (Year: 2013).*
Derwent Abstract of KR 1445718 B1 by Jae (Year: 2014).*
Derwent Abstract of KR 2016085728 A by Lee (Year: 2016).*
Derwent Abstract of CN 106759512 A by Chen et al. (Year: 2017).*
Derwent Abstract of KR 1857247 B1 by Dong et al. (Year: 2018).*

* cited by examiner

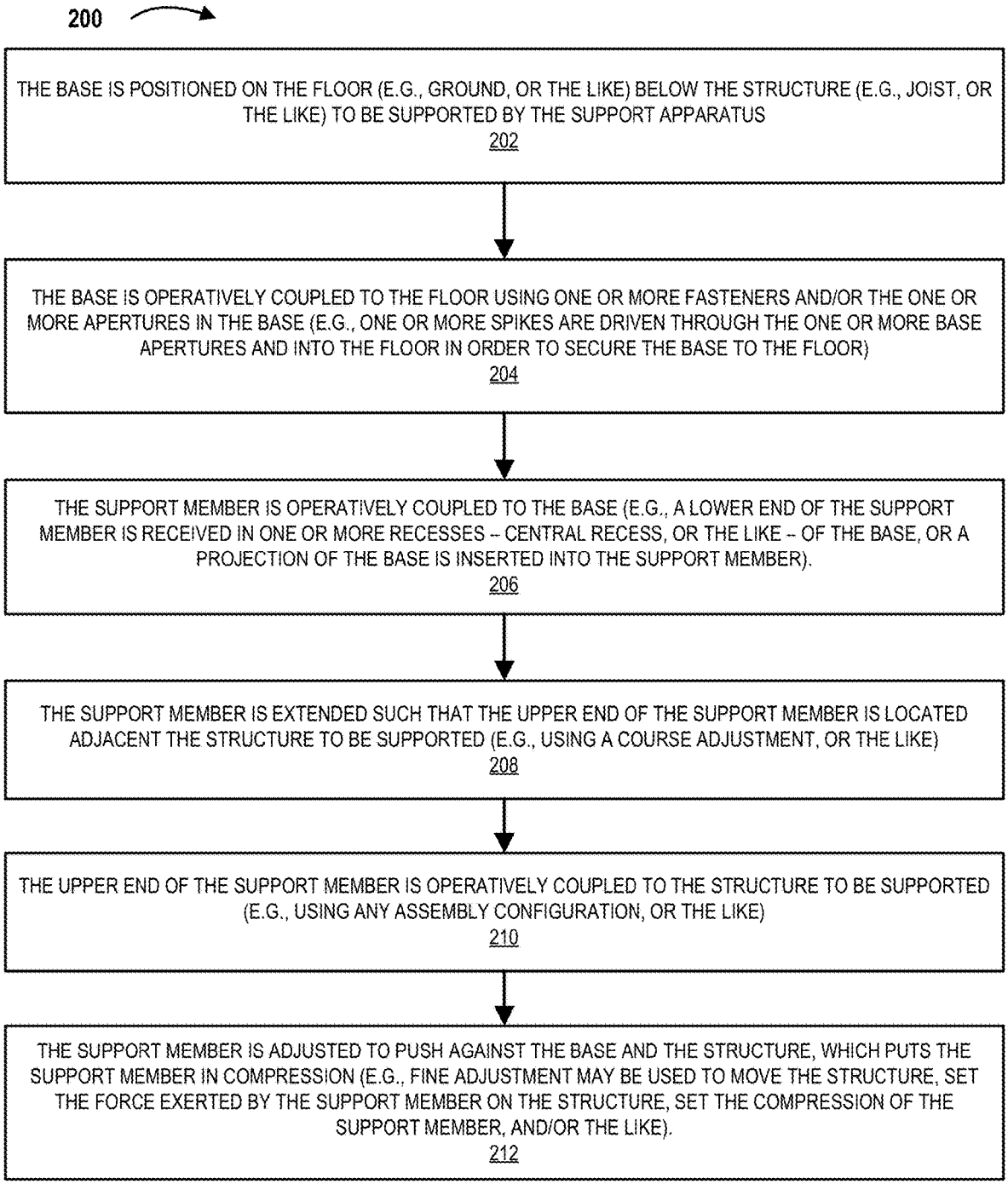
*FIG.* 11

APPARATUS FOR SUPPORTING OVERHEAD STRUCTURE

CROSS REFERENCE AND PRIORITY CLAIM UNDER 35 U.S.C. § 119

The present Application for a patent claims priority to U.S. Provisional Patent Application Ser. No. 62/740,350 entitled "Apparatus for Supporting Overhead Structure" filed on Oct. 2, 2018 and assigned to the assignees hereof and hereby expressly incorporated by reference herein.

FIELD

This application relates generally to an apparatus for supporting a structure, and more particularly, to an apparatus having a base for supporting a support member positioned between the base and the structure being supported.

BACKGROUND

A conventional joist support is a portable structure for supporting overhead building joists that are typically found in residential homes. The joist support includes a member of adjustable length. The length adjustment permits use of the member between the ground and an overhead building joist. Length adjustment can be provided by telescopically interrelating a plurality of components allowing the components to be fixed in any one of several different relative positions to thereby provide a relatively coarse length adjustment for the member. Fine adjustment of the length is typically accomplished by threaded adjustment means, such as a screw and a nut. Manual turning of the screw and/or nut provides lifting capacity necessary to lengthen the member sufficiently so that it may be used to elevate the building joist.

SUMMARY

The present disclosure relates to improved apparatuses for supporting a structure. The support apparatuses generally include a base to support a support member which, in turn, supports a structure. The support apparatus may be used to provide reinforcement between a floor (e.g., ground, or the like) and an overhead structure. The base of the support apparatus is in the form of a generally planar circular base plate, but it may be formed in any shape. The base may have an upper surface and a lower surface with fastener aperture located therein between the upper surface and the lower surface. The base may include one or more platforms, recesses, or ribs in order to provide structural support to the base and/or locations for one or more fastener apertures (e.g., providing additional support to the fastener apertures). The one or more fastener apertures are configured to receive one or more fasteners for operatively coupling the base to the floor (e.g., ground) in order to resist movement of the base during installation and/or use of the support apparatus.

Embodiments of the disclosure comprise a support apparatus for supporting a structure. The support apparatus comprises a support member having a first end and a second end, and a base having one or more fastener apertures, wherein the base is configured to be operatively coupled adjacent the first end of the support member and to a floor. One or more fasteners are configured to operatively couple the base to the floor, and the second end of the support member is configured to be operatively coupled to the structure.

In further accord with embodiments of the disclosure, the base comprises a recess surface that forms a support member recess for receiving the first end of the support member for operatively coupling the support member and the base. In other embodiments of the invention, the support member recess is a central recess. In still other embodiments, the one or more fastener apertures are located within the support member recess. In yet other embodiments, one of the one or more fasteners apertures are concentric with the support member recess.

In other embodiments, the base comprises a raised platform. In further accord with embodiments of the invention, the one or more fastener apertures are located in the raised platform.

In yet other embodiments, the base comprises one or more ribs. In still other embodiments, the one or more fastener apertures are located in the one or more ribs.

In further accord with embodiments of the disclosure, the base comprises one or more radial recesses. In other embodiments, the one or more fastener apertures are located within the one or more radial recesses. In yet other embodiments, the one or more radial recesses comprise one or more radial platforms, and the one or more fastener apertures are located within the one or more radial platforms In still other embodiments, the base comprises a raised platform adjacent a central access of the base; one or more ribs extending from the raised platform; and one or more radial recesses formed by the raised platform and the one or more ribs In further accord with embodiments of the disclosure, the support member comprises an adjustable coupling assembly that is activated to move the second end of the support member with respect to the first end of the support member. In yet other embodiments, the adjustable coupling assembly comprises a coarse adjustment and a fine adjustment.

In other embodiments, the base comprises one or more projections, and wherein the first end of the support member receives the one or more projections of the base.

Embodiments of the disclosure comprise a base for a support apparatus for supporting a structure. The base comprises an upper surface and a lower surface, a raised platform formed in the upper surface, one or more ribs formed in the upper surface, one or more radial recesses formed in the upper surface by the raised platform and the one or more ribs, and one or more fastener apertures extending from the upper surface through the lower surface. In further accord with embodiments of the invention, the one or more fastener apertures are formed in the raised platform, the one or more ribs, or the one or more radial recesses.

Embodiments of the disclosure comprise a method of installing a support structure. The method comprises placing a base below a structure, wherein the base comprises an upper surface and a lower surface, and wherein one or more fastener apertures extend from the upper surface to the lower surface. One or more fasteners in the one or more fasteners apertures to operatively couple the base to a floor. The method further comprises installing a support member to the base, wherein the base receives at least a portion of a lower end of the support member within a recess of the base or the support member receives a projection from the base. The support member is extended between the base and the structure. The upper end of the support member is installed by operatively coupling a portion of a second end of the support member to the structure, and the extension of the support member is adjusted to support the structure.

To the accomplishment of the foregoing and the related ends, the one or more aspects of the invention comprise the features hereinafter fully described and particularly pointed out in the claims. The following description and the annexed drawings set forth certain illustrative features of the one or more aspects of the invention. These features are indicative, however, of but a few of the various ways in which the principles of various aspects of the invention may be employed, and this description is intended to include all such aspects and their equivalents.

BRIEF DESCRIPTION OF THE DRAWINGS

For a more complete understanding of the apparatus for supporting overhead structure, reference should now be had to the embodiments shown in the accompanying drawings and described below. In the drawings:

FIG. 11 is a process for installing a support apparatus for supporting a structure, in accordance with embodiments of the present disclosure.

DESCRIPTION

Certain terminology is used herein for convenience only and is not to be taken as a limiting. For example, words such as "upper," "lower," "left," "right," "horizontal," "vertical," "upper," "lower," "top" and "bottom" merely describe the configurations shown in the FIGS. Indeed, the components may be oriented in any direction and the terminology, therefore, should be understood as encompassing such variations unless specified otherwise. The terminology includes the words specifically mentioned above, derivatives thereof and words of similar import. In addition, where possible, any terms expressed in the singular form herein are meant to also include the plural form and/or vice versa, unless explicitly stated otherwise. Accordingly, the terms "a" and/or "an" shall mean "one or more."

Figure 7:
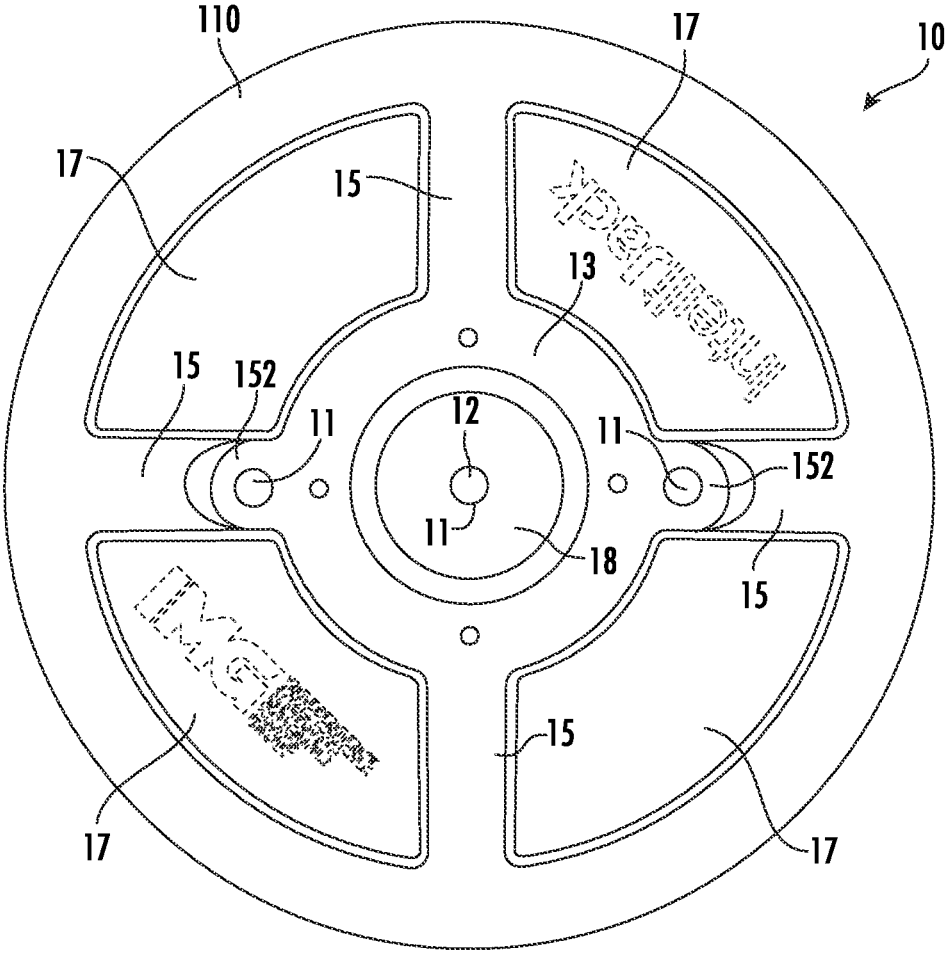
FIG. 7 is a top plan view of a base of a support apparatus for supporting a structure, in accordance with embodiments of the present disclosure.
Figure 8:
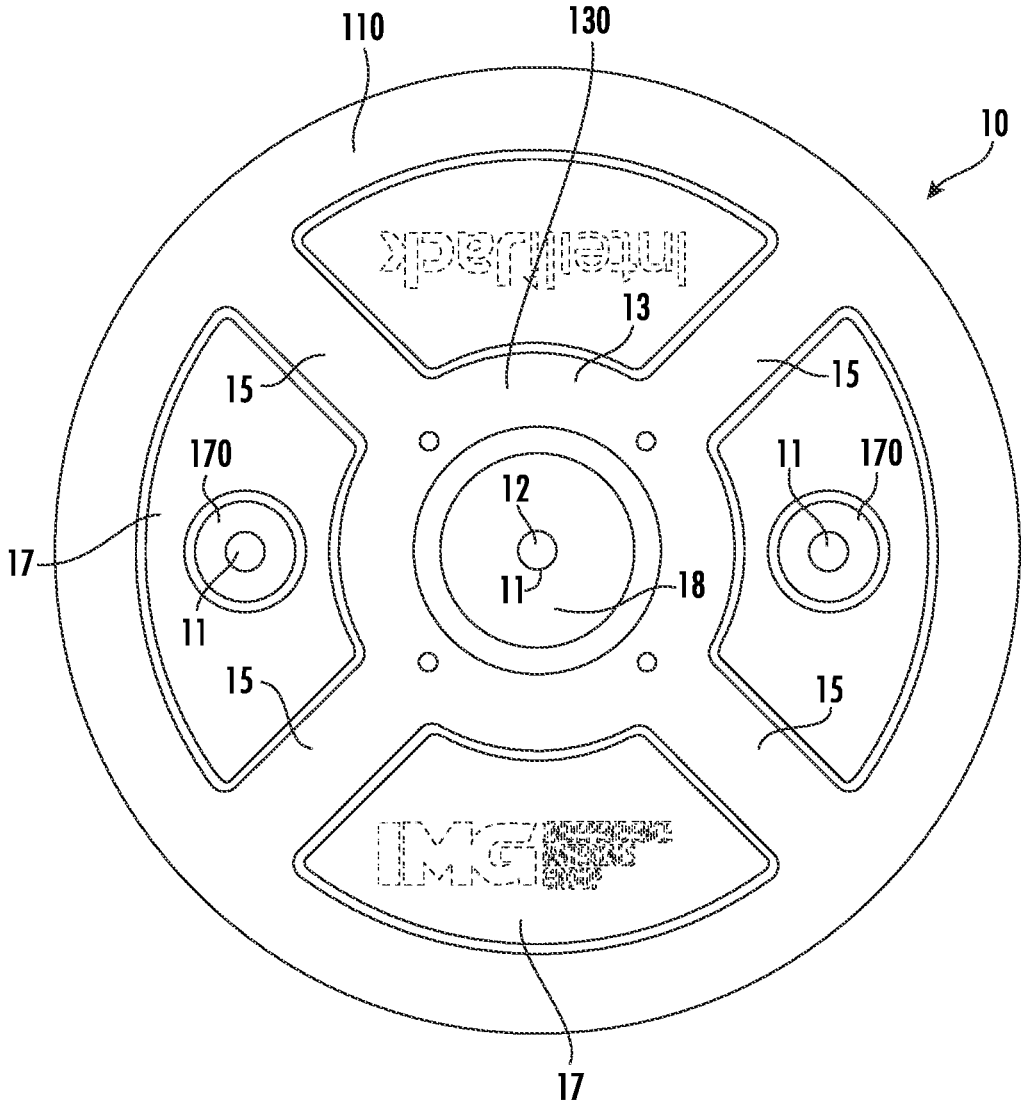
FIG. 8 a top plan view of a base of a support apparatus for supporting a structure, in accordance with embodiments of the present disclosure.
Figure 9:
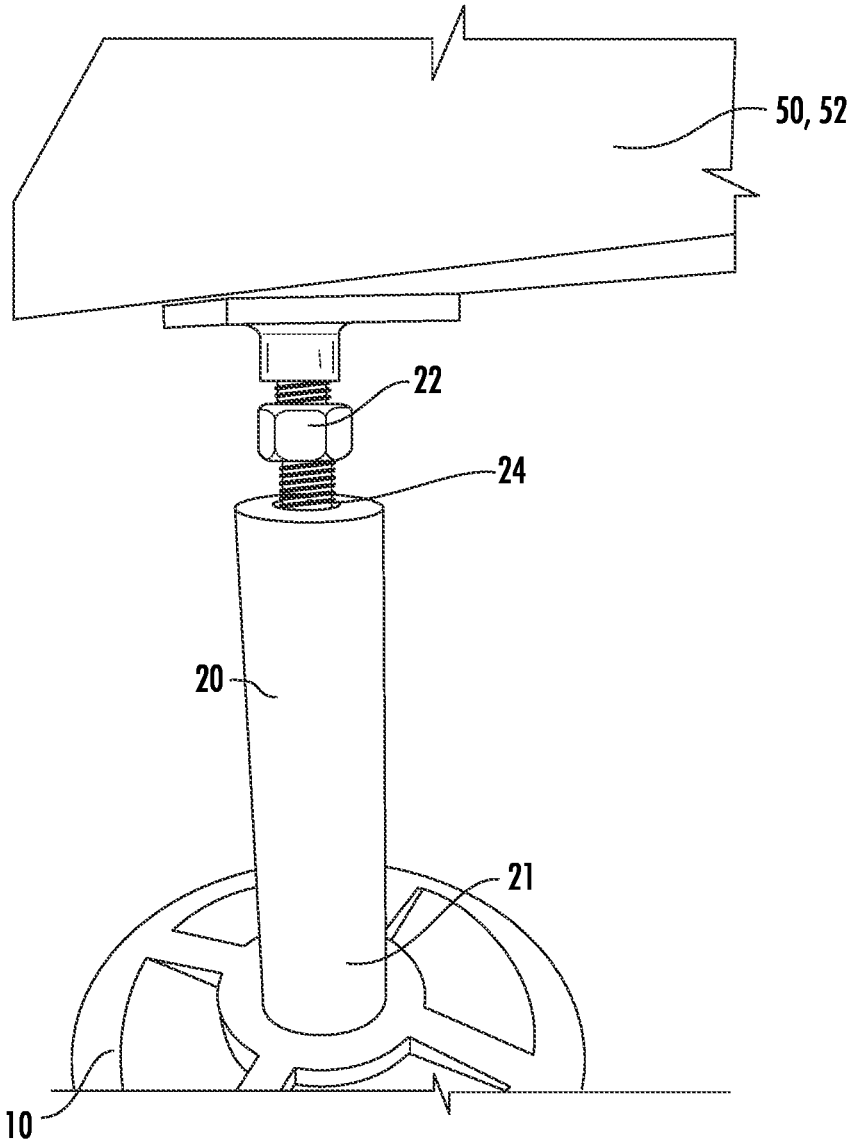
FIG. 9 is a perspective view of an installed support apparatus for supporting a structure, in accordance with embodiments of the present disclosure.
Figure 10:
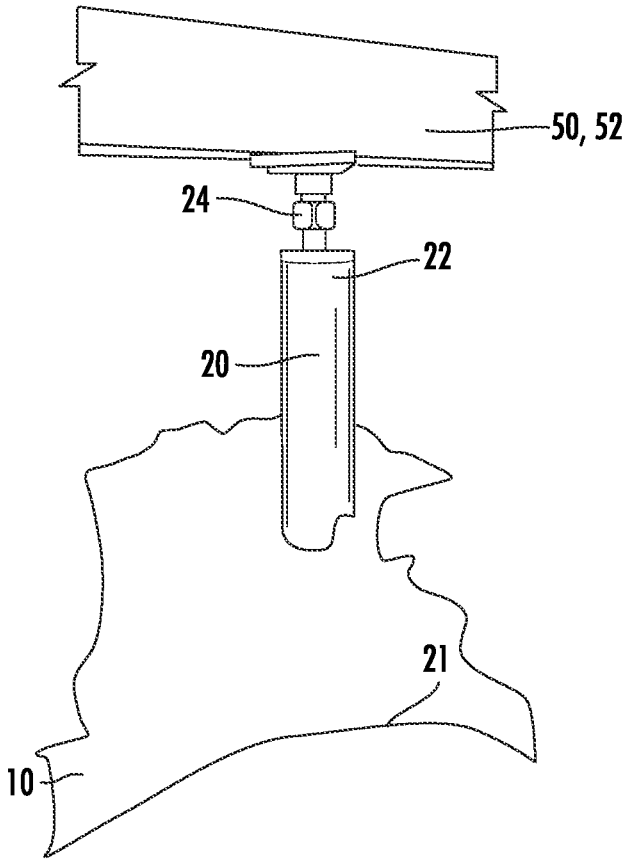
FIG. 10 is a perspective view of an installed support apparatus for supporting a structure, in accordance with embodiments of the present disclosure.

Referring now to the drawings, wherein like reference numerals designate corresponding or similar elements throughout the several views, a support apparatus 1 is provided, and includes a base 10 to support a support member 20 which, in turn, supports a structure 50 (e.g., a building joist, overhead structure, combinations thereof), as illustrated throughout the FIGS. 1-10, and as described herein. The support apparatus 1 may be used to provide reinforcement between a floor 16 (e.g., ground, substrate, or the like such as concrete, dirt, gravel, stone, plastic, composites, or the like) and the structure 50. The support member 20 is supported by disposing the support member 20 between the floor 16 and the structure 50. The structure 50 may include any type of structural supports, such as building joists 52 (as illustrated in FIGS. 9 and 10), girders, I-beams, H-beams, trusses, or the like having a solid configuration and/or including flanges. The structure 50 may be made out of any material, such as beam(s) of lumber, steel, or the like. It is understood that, in addition to the type and material of the structure 50, the structure 50, or components thereof, may have various constructions and the supporting apparatus 1 described herein is not limited to use with any particular type of structure 50. Therefore, the structure 50 is not described in detail herein.

In the embodiments illustrated in FIGS. 1-4, the base 10 of the support apparatus 1 is in the form of a generally planar circular base 10. It is understood that the base 10 does not need to be circular, and thus, may have any desired shape suitable for use as a component of the support apparatus 1, such as oval, square, rectangular, any polygonal shape (e.g., pentagon, hexagon, heptagon, octagon, or the like), any uniform or non-uniform shape, combinations thereof, or the like. The base 10 may have an upper surface 110 and a lower surface 112. The base 10 may comprise one or more fastener apertures 11, such as the illustrated central fastener aperture 12 (otherwise described as an opening), for receiving one or more fasteners 14. The one or more fastener apertures 11 may extend at least partially through the base 10, such as from an upper surface 110 of the base 10 through the lower surface 112 of the base 10. The one or more fasteners apertures 11 may be partially enclosed (e.g., an open slot, or the like) or may be completely enclosed (e.g., a through hole, or the like). The one or more fasteners apertures 11 may receive the one or more fasteners 14 in order to operatively couple the base 10 to a floor 16, as will be described herein in further detail.

Figure 1:
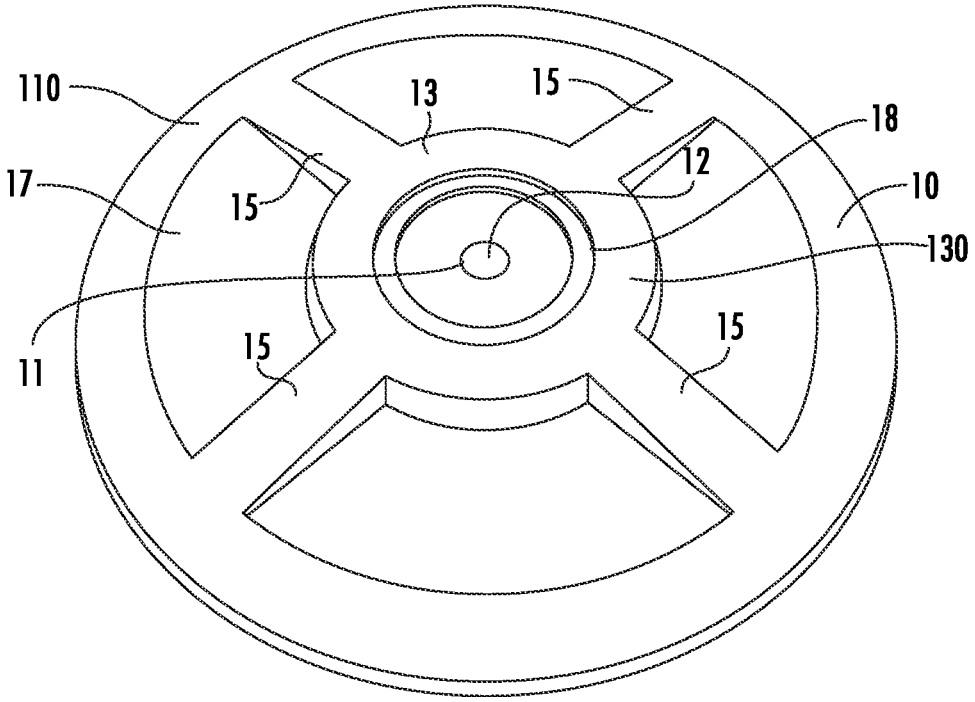
FIG. 1 is a perspective view of a base of a support apparatus for supporting a structure, in accordance with embodiments of the present disclosure.
Figure 2:
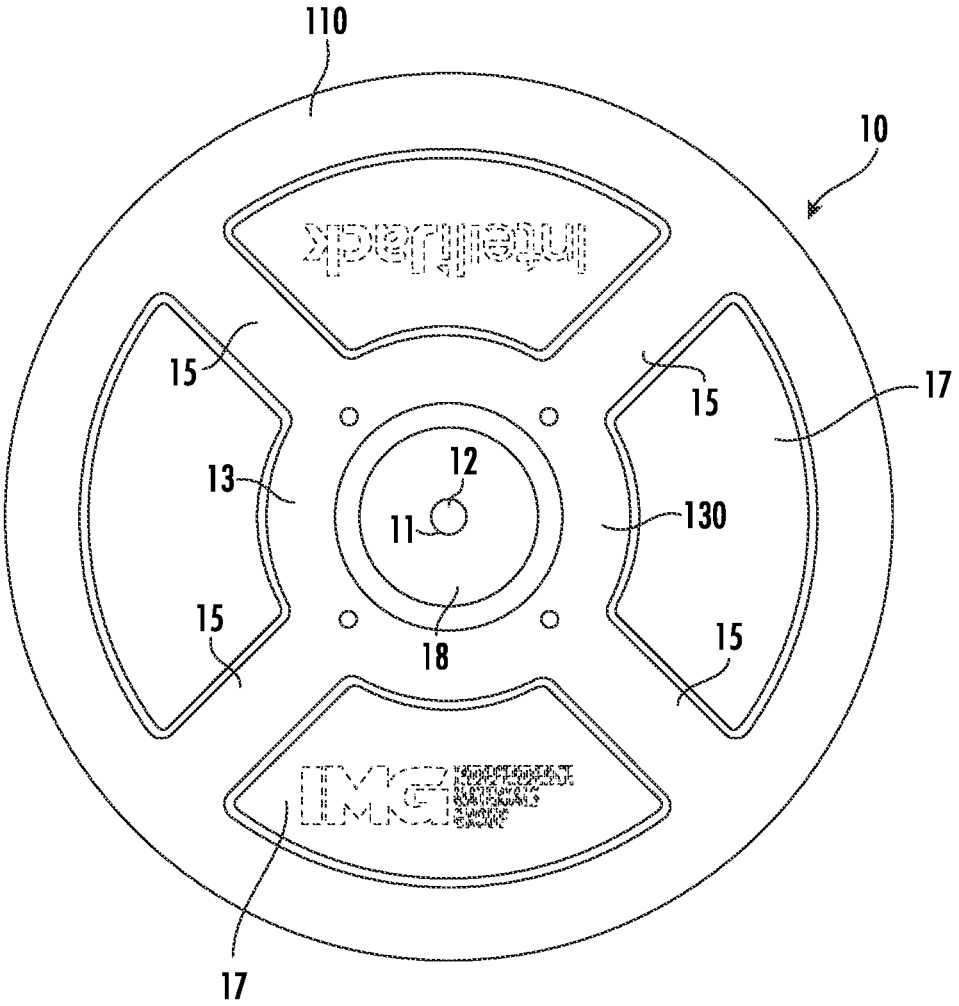
FIG. 2 is a top plan view of the base of the support apparatus for supporting a structure as shown in FIG. 1.
Figure 3:
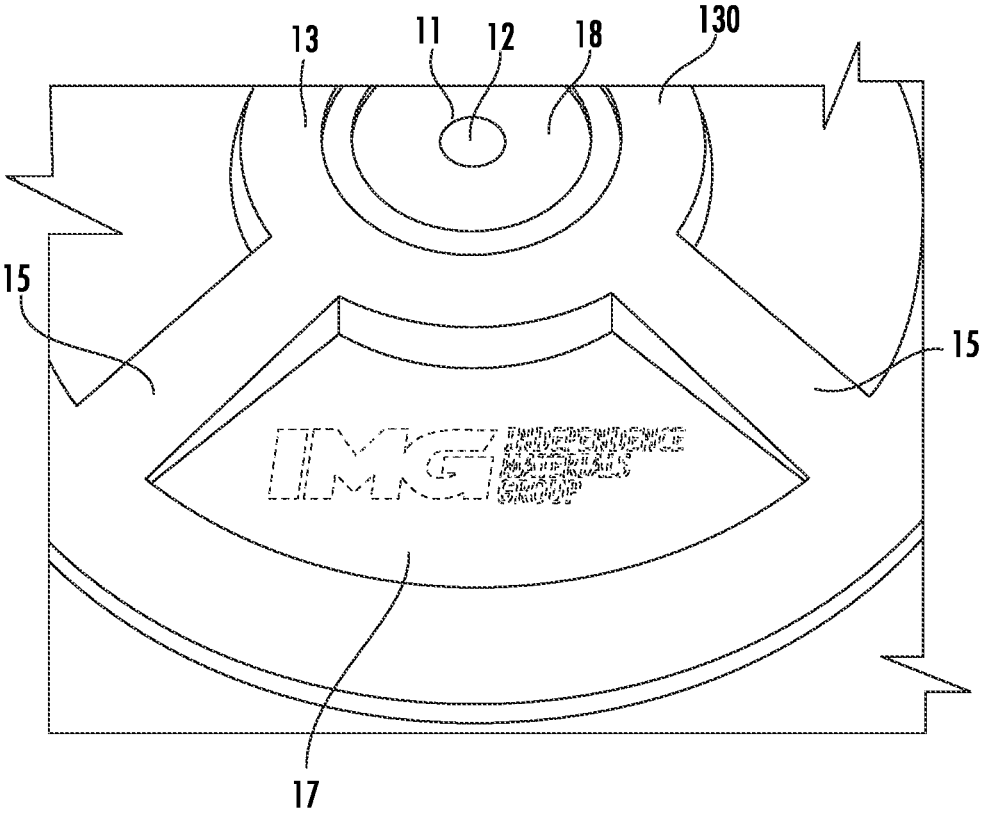
FIG. 3 is a close-up perspective view of the base of the support apparatus for supporting a structure as shown in FIG. 1.
Figure 4:
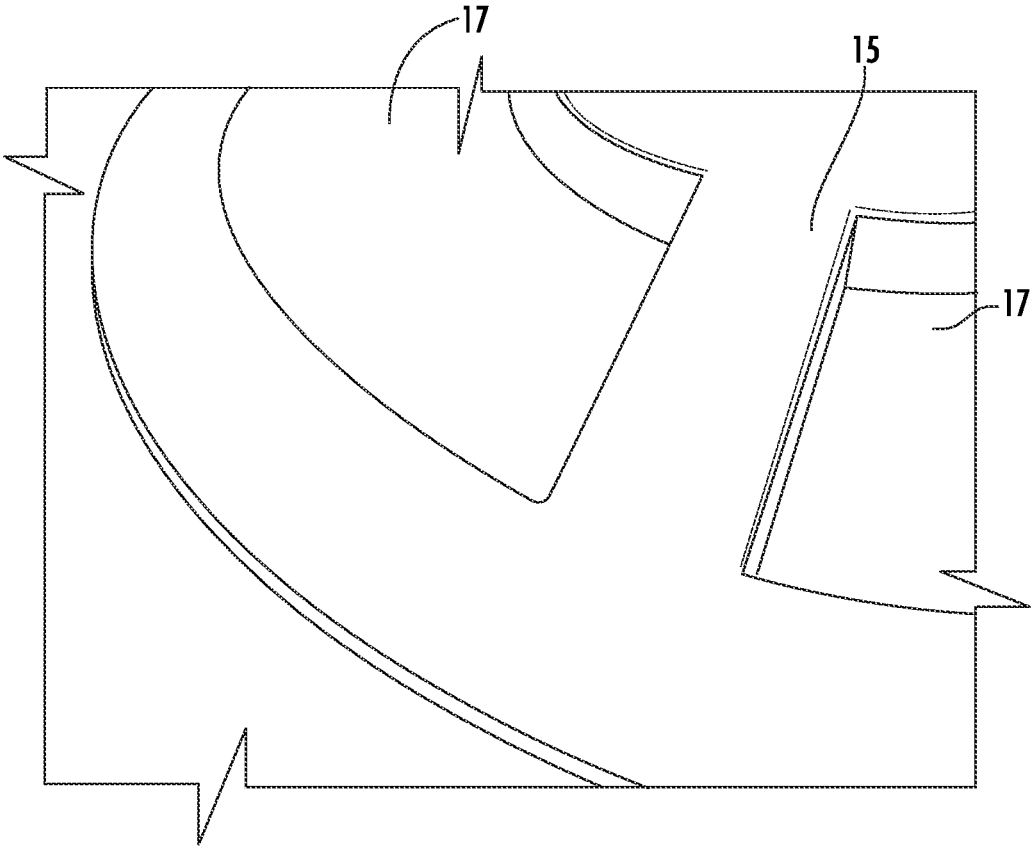
FIG. 4 is a close-up perspective view of the base of the support apparatus for supporting a structure as shown in FIG. 1.
Figure 5:
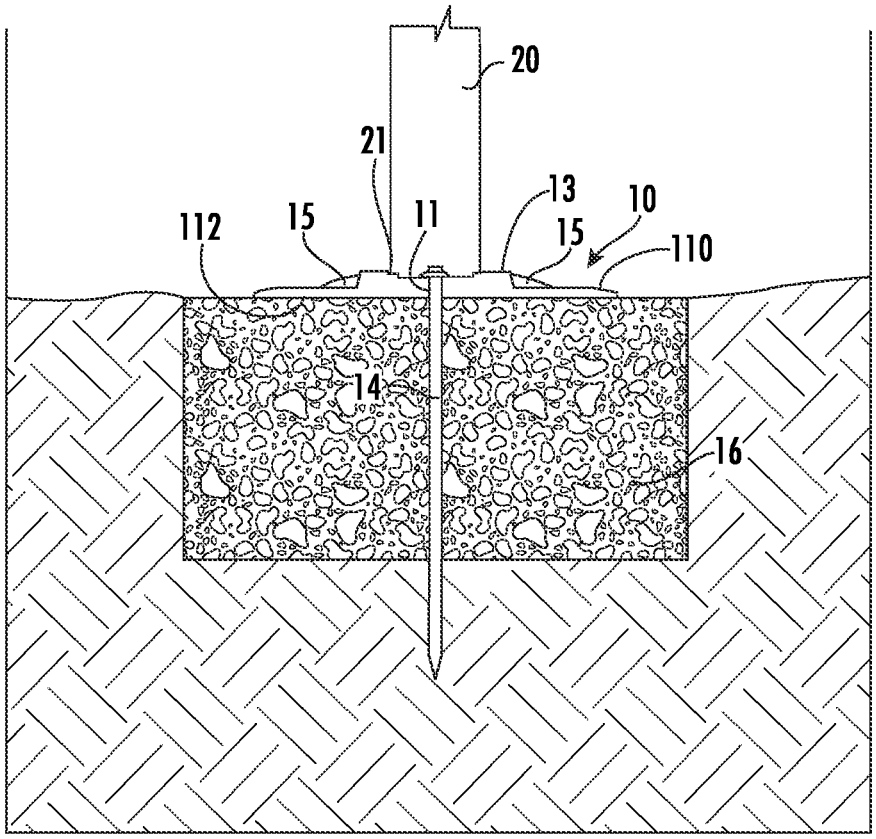
FIG. 5 is a longitudinal cross-sectional view of a portion of a support apparatus illustrating a base, a fastener, and a portion of a vertical support member, in accordance with embodiments of the present disclosure.

The one or more fasteners 14 may be any type of fastener, such as an elongated anchoring spike 140 (e.g., as illustrated and described with respect to FIG. 5), an anchor bolt, a screw, a liquid material that solidifies into a solid fastener (e.g., epoxy, or the like), a mechanical fastener (e.g., clamping fastener, or the like), any other type of fastener, or combinations thereof. The one or more fasteners 14, may be operatively coupled to the floor 16 through the insertion of the one or more fasteners 14 through the one or more fastener apertures 11. For example, as illustrated in FIG. 5 the fastener may be a spike 140, and the spike 140 may be driven through the central fastener aperture 12 and into the floor 16 (e.g., ground, or the like). The one or more fasteners 14 may operatively couple the base 10 to the ground 16 to resist lateral movement of the base 10 along the floor 16, vertical movement of the base 10 off of the floor 16, or combinations thereof during installation and use of the support apparatus 1. As such, the function of the one or more fasteners 14 (e.g., the anchoring spike 140, or the like) is to retain the base 10 in a fixed position when the support member 20 is being utilized to support the structure 50.

In some embodiments, the base 10 further comprises a raised platform 13, such as a raised circular center platform 130 coaxial with the central aperture 12. In other embodiments of the invention, the raised platform 13 may be any type of shape such as oval, square, rectangular, any polygonal shape (e.g., pentagon, hexagon, heptagon, octagon, or the like), any uniform or non-uniform shape, combinations thereof, or the like. The raised platform 13 may comprise one or more support member recesses, such as central recess 18, formed by a recess surface (e.g., one or more walls in the upper surface 110 that form the one or more support member recesses). As such, the raised platform 13 and/or the central recess 18 may form a portion of the upper surface 110 of the base 10. The central recess 18 may also be coaxial with the central aperture 12. Moreover, like the raised platform 13, the central recess 18 may be any type of shape, in order to allow operative coupling with the support member 20 (e.g., a support member 20 of any shape), as will be described in further detail herein. The central recess 18 may be continuous (e.g., as illustrated by the uniformity of the raised platform and the recess) or discontinuous (e.g., have channels such that the recess 18 is formed of one or more projections with one or more channels therebetween).

As further illustrated in the figures, the base 10 may comprise one or more ribs 15, which may form a portion of the upper surface 110 of the base 10. The one or more ribs 15 and/or the raised platform 13 may form one or more radial recesses 17, which may form a portion of the upper surface 110 of the base 10. In some embodiments, the base 10 may comprise four ribs 15 that are spaced around (e.g., equally or unequally) the circumference of the raised platform 13 and extend radially outward, tapering downwardly to the edge of the base 10. In this embodiment, the ribs 15 may create four radial recesses 17. The recesses 17 may reduce the weight of the base 10 without compromising the structural support provided by the base 10.

The base 10 may be formed of any material including metal, plastic, composite, or the like. When the base 10 is made of metal, the metal may comprise aluminum, cast iron, steel, or the like, or any alloy thereof. Regardless of the material of the base 10, the base 10 is suitable to withstand significant compressive forces during use. It is understood that the scope of the disclosure is not intended to be limited by the materials listed here, but instead, may be carried out using any material which allows the construction and operation of the support apparatus 1 described herein.

The support member 20 that is operatively coupled to the base 10, may comprise a lower end 21 (e.g., a first end, or the like) and an upper end 22 (e.g., a second end, or the like). The lower end 21 may be operatively coupled to the base 10, such as for example, to the central recess 18 of the base, a radial recess 17, and/or the like as will be described in further detail herein. The upper end 22 of the support member 20 may be adapted to be operatively coupled to the structure 50 (e.g., engage, or the like), such as a building joist 52 or other overhead structure 50. The upper end 22 of the support member 20 may include a configuration for attaching to the structure 50 (e.g., building joist 52, or other overhead structure). As such, the second end 22 of the support member 20 may be operatively coupled to the structure 50 using a plate, holding clips, fasteners (e.g., screws, bolts, or the like), channels, any mechanical, or other like coupling. In one embodiment, a self-aligning channel may be provided on the upper end 22 of the support member 20 for contacting the structure 50. It should also be understood that the length of the support member 20 can be selected for a particular height above the base 10 and variations are deemed a part of this description. For example, an adjustable coupling assembly 24, such as a threaded screw, may be connected between the upper end 22 and the lower end 21 of the support member 20 for adjusting the relative axial distance separating the upper end 22 and lower end 21. Adjusting the length of the support member 20 in this manner causes the ends 21, 22 of the support member 20 to be operatively coupled to (e.g., engage, or the like) and press against the base 10 and the structure 50, respectively. The support member 20 is thus held in compression between the base 10 and the structure 50. While some examples of the connection between the upper end 22 of the support member 20 and the structure 50 described herein, it should be understood that the upper end 22 of the support member 20 may be operatively coupled to a structure 50 in any way and/or the support member 20 may be adjusted in any way.

Figure 6:
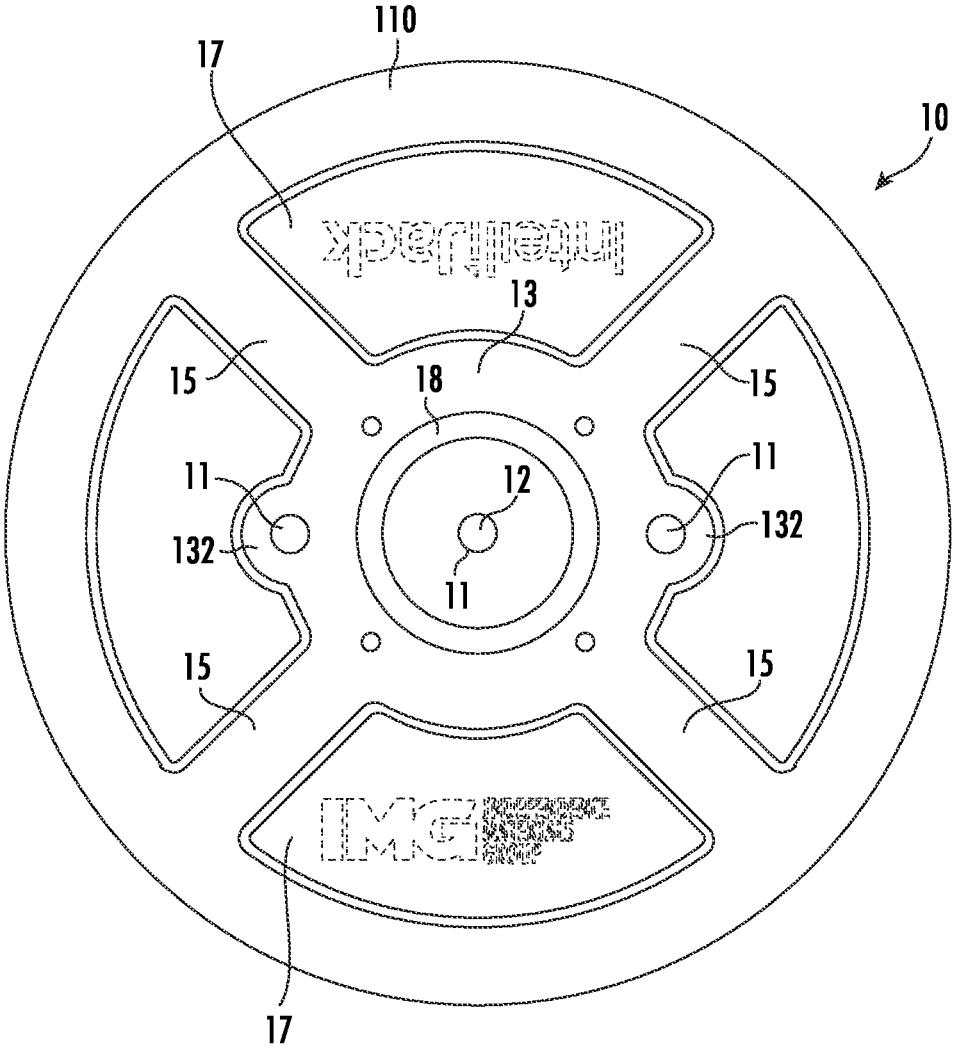
FIG. 6 is a top plan view of a base of a support apparatus for supporting a structure, in accordance with embodiments of the present disclosure.

While some embodiments of the base 10 having a central aperture 12 for receiving a fastener 14 have been described herein, in other embodiments of the disclosure the base 10 may have one or more fastener apertures 11 located in other positions within the base 10. For example, as illustrated in FIG. 6, the raised platform 13 may include one or more platform extensions 132 (e.g., opposed semi-circular platform extensions, or the like). As illustrated in FIG. 6, the one or more platform extensions 132 may include one or more fastener apertures 11 for receiving the one or more fasteners 14. The base 10 may be operatively coupled (e.g., secured) to the floor 16 (e.g., ground, or the like) by the one or more fasteners 14 (e.g., two anchoring spikes 14, or the like) through the one or more platform extensions 132.

In other embodiments, as illustrated in FIG. 7, the one or more ribs 15 may comprise one or more rib extensions 152. As previously described with respect to the one or more platform extensions 132, the one or more rib extensions 152 may include one or more fastener apertures 11 for receiving the one or more fasteners 14. The base 10 may be operatively coupled to (e.g., secured) the floor 16 (e.g., ground, or the like) by the one or more fasteners 14 (e.g., two anchoring spikes 14, or the like) through at least a portion of the one or more rib extensions 152.

In the embodiments shown in FIG. 8, the central raised platform 130 is bounded by one or more radial platforms 170 (e.g., radially opposed platforms 170), which may be located within the radial recesses 17. As previously described with respect to the one or more platform extensions 132 and/or the one or more rib extensions 152, the one or more radial platforms 170 may include one or more fastener apertures 11 for receiving the one or more fasteners 14. The base 10 may be operatively coupled (e.g., secured) to the floor 16 (e.g., ground, or the like) by the one or more fasteners 14 (e.g., two anchoring spikes 14, or the like) through the one or more radial platforms 170.

It should be understood that the base 10, the one or more fasteners 14, the support member 20, and/or other components thereof, may be provided in a kit. The kit is easily assembled and provides for ease of transportation and/or assembly on site. Multiple kits may be utilized such that a plurality of support apparatuses 1 may be used within a dwelling for supporting one or more structures 50.

FIG. 11 illustrates a method of installing the support apparatus 1. Moreover, FIGS. 5, 9 and 10 illustrate an installed support apparatus 1. As illustrated in block 202 of FIG. 11 and in the embodiments of FIGS. 5, 9 and 10, the base 10 is positioned on the floor 16 (e.g., ground, other substrate, or the like) beneath a structure 50 (e.g., building joist 52, or the like) to be supported. It should be understood that the base 10 may be placed directly on the exposed floor 16, or a portion of the localized floor may be removed (e.g., dug out, or the like) such that the base will sit below the surface of the floor and be covered after installation (e.g., with dirt, or the like) as illustrated in FIGS. 9 and 10.

Thereafter, as illustrated by block 204 of FIG. 11 and in the embodiment of FIG. 5, the one or more fasteners 14 operatively couple the base 10 to the floor 16 (e.g., a spike 140 is driven through the central apparatus 12 and into the floor 16 for securing the base 10 to the floor 16). The function of the one or more fasteners 14 (e.g., the anchoring spike 140, or the like) is to retain the base 10 in a fixed position when the support member 20 is being utilized to support the overhead structure. The base 10 provides a large supporting surface area for the lower end 21 of the support member 20, and aids in restricting movement of the base 10 during adjustment of the support member 20 (e.g., compression due to expanding the length of the support member).

Block 206 of FIG. 11, and the embodiment of FIG. 5, illustrate the support member 20 operatively coupled to the base 10. For example, in some embodiments of the disclosure, the lower end 21 of the support member 20 may be received in one or more recesses (e.g., central recess 18, or the like) of the base 10. Additionally, or alternatively, a projection from the base 10 (not illustrated) is inserted into a portion of the lower end 21 of the support member 20. The arrangement between the lower end 21 of support member 20 provides for self-alignment of the support member 20 in relation to the base 10.

FIG. 11 illustrates in block 208, that the support member 20 may be extended in order to span between the base 10 and the structure 50. For example, the support member 20 may extend using a course adjustment, as previously described, such as the telescoping movement of a first support member to a second support member, as illustrated in FIGS. 9 and 10. As such, the support member 20 may be extended generally vertically upwardly and generally perpendicular to the surfaces of the base 10 until an upper end 22 of the support member 20 is located adjacent to the structure 50 to be supported, as illustrated in FIG. 10.

Block 210 of FIG. 11, and the embodiments illustrated in FIG. 10, illustrate that the upper end 22 of the support member 20, may be operatively coupled to the structure 50 (e.g., building joist 52, or other overhead structure) and may include the configurations previously described herein.

FIG. 11 illustrates in block 212, that the support member 20 may be further adjusted such that is pushes against the base 10 and the structure 50 being supported, which puts the support member 20 in compression. For example, a fine adjustment feature (e.g., threaded nut and bolt, or the like) may be utilized in order to move the structure 50 (e.g., raise the structure), set the force exerted by the support member 20 on the structure 50, set the compression of the support member 20, or the like. The support member 20 may be adjusted until the desired movement of the structure 50, the desired force exerted by the support member 20, the desired compression of the support member 50, or the like is met.

It should be understood that the support apparatus 1 of the present disclosure provides a number of benefits. For example, the base 10 provides a large supporting surface area for the lower end 21 of the support member 20. The platform, ribs, and/or recesses reduce the weight of the base while maintain structural support and/or locations for the fastener apertures that provide the desired support for the one or more fasteners. Effective use of the support apparatus 1 requires a solid positioning of the lower end, which is provided by the base 10 described herein. The base 10 is used to aid in positioning the support member 20 under the structure 50 in order to reduce (e.g., prevent, or the like) lifting of the structure 50 in an angular or off center position during adjustment of the support member. Moreover, the base 10 is operatively coupled to the floor (e.g., ground, or the like), which provides a stable position that does not allow the support member 20 to move or slide laterally during installation and/or operation (e.g., support member maintains vertical orientation during installation and/or adjustment during installation or in the future).

Moreover, it should be understood that "operatively coupled," when used herein, means that the components may be formed integrally with each other, or may be formed separately and coupled together. Furthermore, "operatively coupled" means that the components may be coupled directly to each other, or to each other with one or more components located between the components that are operatively coupled together. Furthermore, "operatively coupled" may mean that the components are detachable from each other, or that they are permanently coupled together.

Furthermore, certain terminology is used herein for convenience only and is not to be taken as limiting, unless such terminology is specifically described herein for specific embodiments. For example, words such as "vertical" and "horizontal", are used to describe the orientation of components, such as the support member 20. It should be understood that when using the terminology "vertical" this could mean perpendicular (e.g., 90 degrees with respect to the floor) or generally perpendicular (e.g., within +/−5, 10, 15 degrees from 90 degrees with respect to the floor), or the like. Furthermore, when using the terminology "horizontal" this could mean parallel (e.g., 0 degrees with respect to the floor), generally parallel (e.g., +/−5, 10, 15 degrees from 0 degrees with respect to the floor), or the like.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

What is claimed is:

1. A support apparatus for supporting a structure, the support apparatus comprising:

a support member, wherein the support member comprises:

a first support member having a first end for operative coupling with a base; and a second support member having a second end for operative coupling with a structure support;

wherein the second support member and the first support member have a telescoping course adjustment that allows the second support member move relative to the first support member;

the base comprising:

a raised platform having a recessed surface that forms a first support member recess and a second support member recess, wherein the first support member recess and the second support member recess are continuous concentric circles, wherein the first support member recess and the second support member recess are configured to receive support members having different sizes, and wherein the first support member recess or the second support member recess receive the first end of the support member;

an edge, wherein the edge is a circular tapered edge;

two or more ribs extending from the raised platform and tapering to the edge of the base, wherein the raised platform, the edge of the base and the two or more ribs form an upper surface of the base;

two or more radial recesses formed by the raised platform, the edge of the base, and the two or more ribs, wherein the two or more radial recesses are located below the upper surface; and one or more fastener apertures, wherein at least one fastener aperture of the one or more fastener apertures is located within the recessed surface of the raised platform;

wherein the base is configured to be operatively coupled to a floor through the at least one fastener aperture within the recessed surface of the raised platform;

one or more fasteners configured to operatively couple the base to the floor, wherein at least one fastener operatively couples the base to the floor through the at least one fastener aperture located within the recessed surface of the raised platform;

a plate configured to be operatively coupled to a lower surface of the structure support, and wherein the plate receives the second end of the second support member;

an adjustable coupling assembly operatively coupled to the support member, wherein the adjustable coupling assembly is activated to move the second end of the second support member with respect to the first end of the first support member; and wherein the second end of the support member is configured to be operatively coupled to the structure.

2. The support apparatus of claim 1, wherein the recessed surface is a central recess within the base.

3. The support apparatus of claim 1, wherein the at least one fastener aperture of the one or more fasteners apertures are concentric with the first support member recess and the second support member recess.

4. The support apparatus of claim 1, wherein the two or more ribs comprise four ribs that form four radial recesses.

5. The support apparatus of claim 1, wherein at least one additional fastener aperture of the one or more fastener apertures are located in the raised platform.

6. The support apparatus of claim 1, wherein the first end of the support member is circular.

7. The support apparatus of claim 1, wherein the one or more fastener apertures comprise at least one fastener aperture located in the one or more ribs.

8. The support apparatus of claim 1, wherein the one or more fastener apertures comprise at least one fastener aperture located within at least one of the two or more radial recesses.

9. The support apparatus of claim 1, wherein the two or more radial recesses comprise one or more radial platforms, and wherein the one or more fastener apertures comprise at least one fastener located within the one or more radial platforms.

10. The support apparatus of claim 1, wherein the base comprises one or more projections, and wherein the first end of the support member receives the one or more projections of the base.

* * * * *